US005590971A

United States Patent [19]

Melnick

[11] Patent Number: 5,590,971

[45] Date of Patent: Jan. 7, 1997

[54] MARKING PEN AND CAP

[75] Inventor: Norman Melnick, Edison, N.J.

[73] Assignee: Pentech International Inc., Edison, N.J.

[21] Appl. No.: 494,511

[22] Filed: Jun. 26, 1995

[51] Int. Cl.[6] ..... B43K 9/00

[52] U.S. Cl. ..... 401/202; 401/98; 401/213; 401/243; 401/262

[58] Field of Search ..... 401/202, 213, 401/243, 262, 98

[56] References Cited

U.S. PATENT DOCUMENTS

| | | |
|---|---|---|
| D. 197,368 | 1/1964 | Sydlowski . |
| 1,423,448 | 7/1922 | O'Connor . |
| 1,494,443 | 5/1924 | Pollak . |
| 1,615,506 | 12/1927 | Felt . |
| 1,859,775 | 1/1932 | Hyams . |
| 2,590,329 | 3/1952 | Kromray . |
| 3,944,372 | 3/1976 | Verona . |
| 4,090,647 | 5/1978 | Dunning . |
| 4,269,523 | 5/1981 | Kay . |
| 4,380,403 | 4/1983 | Endres et al. . |
| 4,459,059 | 7/1984 | Greenspan . |
| 4,509,875 | 4/1985 | Shintani . |
| 4,518,273 | 5/1985 | Larizza . |
| 4,653,949 | 3/1987 | Larizza . |
| 4,717,275 | 1/1988 | Burkhardt, Jr. . |
| 4,790,678 | 12/1988 | Araki . |
| 4,911,571 | 3/1990 | Inoue et al. . |
| 4,969,766 | 11/1990 | Nagle et al. . |
| 5,000,604 | 3/1991 | Isoda . |
| 5,176,460 | 1/1993 | Garry . |
| 5,230,578 | 7/1993 | Fuhrmann et al. . |
| 5,336,011 | 8/1994 | Ferguson et al. . |
| 5,352,053 | 10/1994 | Reitze . |
| 5,427,464 | 6/1995 | Nakagawa . |

*Primary Examiner*—Steven A. Bratlie
*Attorney, Agent, or Firm*—Sperry, Zoda & Kane

[57] ABSTRACT

A marking pen design with a cap attached to the barrel of the pen wherein the cap is securable with respect to a reduced diameter end piece surrounding a marking tip and is removable therefrom while maintaining attachment with respect to the barrel to be detachable secured into a tubular bore extending perpendicular to the longitudinal axis of the marking pen. The longitudinal bore is preferably tubular in shade and the cap is preferably of a tapered tubular shape to facilitate wedging interconnection therebetween. The attachment of the cap to the pen is by way or a flexibly resilient means preferably including a loop detachably secured in a peripheral slot defined about the outer circumference of the pen barrel. The pen cap further includes an inner and outer cap means with venting means therebetween wherein the inner cap means engages the reduced diameter flange for preventing drying of the marking tip.

20 Claims, 2 Drawing Sheets

90°
Y
X

MARKING PEN AND CAP

BACKGROUND OF THE INVENTION

1. Field Of The Invention

The present invention deals generally with the field of writing instruments. Writing instruments such as markers and pens commonly include a marking tip connected to a reservoir for holding the marking medium within the barrel of the pen in fluid flow communication with the tip. Many designs have been utilized for different caps and cap retaining configurations since a cap is necessary in order to prevent drying out of the tip during times when the pen is not in use. The present invention is pertinent in regard to marking pens, ballpoint pens, roller pens and any other similarly configured writing instruments.

2. Description Of The Prior Art

Prior art designs have been utilized for the purposes which include caps and in further detail may include caps designed to be attached with respect to the pen to prevent loss thereof while the pen is in use. Examples of such designs are shown in U.S. Pat. No. 1,423,448 issued Jul. 18, 1922 to J. O'Connor on a "Fountain Pen"; and U.S. Pat. No. 1,494,443 issued May 20, 1924 to A. Pollack and assigned to Samuel Kanner on a "Lead Pencil"; and U.S. Pat. No. 1,615,506 issued Jan. 25, 1927 to G. Felt on a "Cap Attachment For Fountain Pens"; and U.S. Pat. No. 1,859,775 issued May 24, 1932 to L. Hyams on an "Attachment For Pencils And Like Instruments"; and U.S. Pat. No. 2,590,329 issued Mar. 25, 1952 to V. Kromray on a "Lipstick And Brush Compact"; and U.S. Design Pat. No. Des.197,368 issued Jan. 14, 1964 to W. Sydlowski and assigned to The Risdon Manufacturing Company on a "Cosmetic Container"; and U.S. Pat. No. 3,944,372 issued Mar. 16, 1976 to F. Verona and assigned to Aurora S.p.A. on a "Device For Fastening The Cap Of A Fountain Pen Upon The Rear Portion Of The Body Or Barrel Of The Pen"; and U.S. Pat. No. 4,090,647 issued May 23, 1978 to B. Dunning on an "Applicator Container"; and U.S. Pat. No. 4,269,523 issued May 26, 1981 to J. Kay on "Pencils And Pencil Caps"; and U.S. Pat. No. 4,380,403 issued Apr. 19, 1983 to B. Endres et al and assigned to J. S. Staedtler K. G. on a "Closure Cap For A Writing Instrument"; and U.S. Pat. No. 4,459,059 issued Jul. 10, 1984 to D. Greenspan on a "Sliding Cap With Frictional Engagement"; and U.S. Pat. No. 4,509,875 issued Apr. 9, 1985 to K. Shintani and assigned to Colleen Pencil Co., Ltd. on a "Felt Pen Having Two End Caps"; and U.S. Pat. No. 4,518,273 issued May 21, 1985 to P. Larizza and assigned to Larizza & Scuratti s.d.f. on an "Instrument For Writing And Drawing With Pivotable Cover"; and U.S. Pat. No. 4,653,949 issued Mar. 31, 1987 to P. Larizza and assigned to Snappy s.r.l. on a "Writing Or Drafting Instrument With Cap Actuator"; and U.S. Pat. No. 4,717,275 issued Jan. 5, 1988 to D. Burkhardt, Jr. on a "Writing Instrument With A Retractable Clip"; and U.S. Pat. No. 4,790,678 issued Dec. 13, 1988 to T. Araki and assigned to Pilot Ink Co., Ltd. on a "Mechanism For Extruding And Retracting A Writing Member Of A Writing Instrument"; and U.S. Pat. No. 4,911,571 issued Mar. 27, 1990 to S. Inoue et al and assigned to Sakura Color Products Corporation; and U.S. Pat. No. 4,969,766 issued Nov. 13, 1990 to G. Nagle et al and assigned to Binney & Smith, Inc. on a "Cap For Marking Instruments"; and U.S. Pat. No. 5,000,604 issued Mar. 19, 1991 to T. Isoda and assigned to Mitsubishi Pencil Co., Ltd. on a "Removable Cap Attached To A Writing Instrument"; and U.S. Pat. No. 5,176,460 issued Jan. 5, 1993 to P. Garry and assigned to Stry-Lenkoff Company on a "Pen Cap For A Writing instrument Barrel"; and U.S. Pat. No. 5,230,578 issued Jul. 27, 1993 to A. Fuhrmann, III et al and assigned to BIC Corporation on a "Cap For Writing And Marking Instruments"; and U.S. Pat. No. 5,336,011 issued Aug. 9, 1994 to G. Ferguson et al and assigned to Precision Handling Devices Inc. on a "Storage Cap With Spring Biased Female Threads"; and U.S. Pat. No. 5,352,053 issued Oct. 4, 1994 to F. Reitze on a "Writing Instrument And Cap".

SUMMARY OF THE INVENTION

The present invention provides an improved marking pen being especially advantageous when used by children which includes a pen barrel extending longitudinally and being preferably of a tubular configuration. This barrel includes a first end with a marking tip positioned thereadjacent to facilitate marking use of this pen. The pen barrel also includes a second end at the opposite location along the pen barrel.

The pen barrel also defines an axis extending longitudinally therethrough. The pen barrel also defines a cap retaining bore therein which is oriented approximately perpendicularly with respect to the axis of the barrel to facilitate retaining of a cap therein selectively.

The design further includes a cap configuration extending longitudinally and defining a cap axis defined longitudinally therethrough. This cap is attachable with respect to the first end of the pen barrel in a position with the cap axis and the barrel axis coincident with respect to one another. The cap in this position will extend over the marking tip to prevent marking therewith. The cap may also be detachable from the first end to allow marking use of the marking tip and the marking pen of the present design.

Also the cap may be removed from engagement with the first end and be positioned detachably extending through the cap retaining bore. In this configuration the axis of the cap and the axis of the retaining bore will be coincident and will be oriented approximately perpendicularly with respect to the barrel axis of the pen barrel.

The invention further includes an attachment device which is secured to the cap and secured to the pen barrel to facilitate retainment therebetween. This attachment means preferably comprises a flexibly resilient strap detachably secured with respect to the pen barrel and fixedly secured with respect to the cap. The means of attachment of the attachment strap with respect to the pen barrel preferably is by including of a flexibly resilient loop in the end of the attachment strap opposite from the point of securement to the cap. Also, the pen barrel will define a slot positioned peripherally about the outer circumference of the barrel positioned therealong. The flexibly resilient loop member will be adapted to be stretched to a more open position and slid down the pen barrel to snap in place extending into the peripheral slot defined on the pen barrel. In this manner the cap can be movably and detachably secured with respect to the pen barrel to prevent loss of the cap during use of the marking tip of the improved marking pen of the present design.

The configuration of the cap itself preferably includes an inner and outer cap member. The inner cap member is designed to be positioned within the outer cap member and defines therebetween a pen means to facilitate passage of air to the interior portion of the outer cap means outside of the inner cap. The outer cap is designed to be in abutment with respect to the first end of the pen barrel whereas the inner cap is adapted to be in engaging position with respect to the reduced diameter flange extending about the marking tip adjacent the first end of the tip barrel. In this manner the marking tip will be prevented from drying when the cap is in place extending thereover while at the same time free flowing of air through the cap is achieved for safety. The pen barrel may define a barrel chamber therein for holding of a fluid marking medium within a marking medium reservoir which may be located therein in one of the variety of different manners depending on the type of writing instrument being utilized. With the marking pen a large chamber may define the fluid reservoir which is in fluid flow communication with the marking tip. On the other hand, with a roller ball or marking ball pen the reservoir may be a narrow ballpoint pen refill configuration as conventionally and currently used.

It is an object of the present invention to provide an improved marking pen with cap attachment and storage means and a detachable tip sealing means wherein cost of manufacture is minimized.

It is an object of the present invention to provide an improved marking pen with cap attachment and storage means and a detachable tip sealing means wherein efficiency of marketing is enhanced.

It is an object of the present invention to provide an improved marking pen with cap attachment and storage means and a detachable tip sealing means wherein drying of the markin tip of a marking pen is prevented.

it is an object of the present invention to provide an improved marking pen with cap attachment and storage means and a detachable tip sealing means wherein a cap for a marking pen is detachable secured with respect to the barrel of the marking pen itself.

It is an object of the present invention to provide an improved marking pen with cap attachment and storage means and a detachable tip sealing means wherein the cap of a marking pen can be stored in a orientation with the axis of the cap extending perpendicular with respect to the axis of the marking pen itself.

It is an object of the present invention to provide an improved marking pen with cap attachment and storage means and a detachable tip sealing means wherein a cap can be attached with respect to the pen barrel of a marking pen and be movable between a retained position extending within a retainment bore at a position extending over the marking tip to prevent drying thereof.

It is an object of the present invention to provide an improved marking pen with cap attachment and storage means and a detachable tip sealing means wherein a cap is secured with respect to a marking pen by a flexibly resilient attaching strap.

It is an object of the present invention to provide an improved marking pen with cap attachment and storage means and a detachable tip sealing means wherein a cap is included with a tapered configuration to facilitate wedging engagement thereof positioned in the storage location within a tubular retaining bore defined in the barrel of the marking pen.

It is an object of the present invention to provide an improved marking pen with cap attachment and storage means and a detachable tip sealing means wherein a cap is included having an inner and outer cap member with a vent means therebetween for safety.

It is an object of the present invention to provide an improved marking pen with cap attachment and storage means and a detachable tip sealing means wherein an inner and outer cap means is included which is operable with respect to a reduced diameter end flange on a pen barrel configuration to facilitate preventing ambient air from contacting the marking pen during non-use thereof while still including an air vent means extending through the body of the pen cap.

It is an object of the present invention to provide an improved marking pen with cap attachment and storage means and a detachable tip sealing means wherein maintenance costs are minimized.

It is an object of the present invention to provide an improved marking pen with cap attachment and storage means and a detachable tip sealing means wherein the method of manufacture can be greatly simplified.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figures 1, 2, 3, 7:
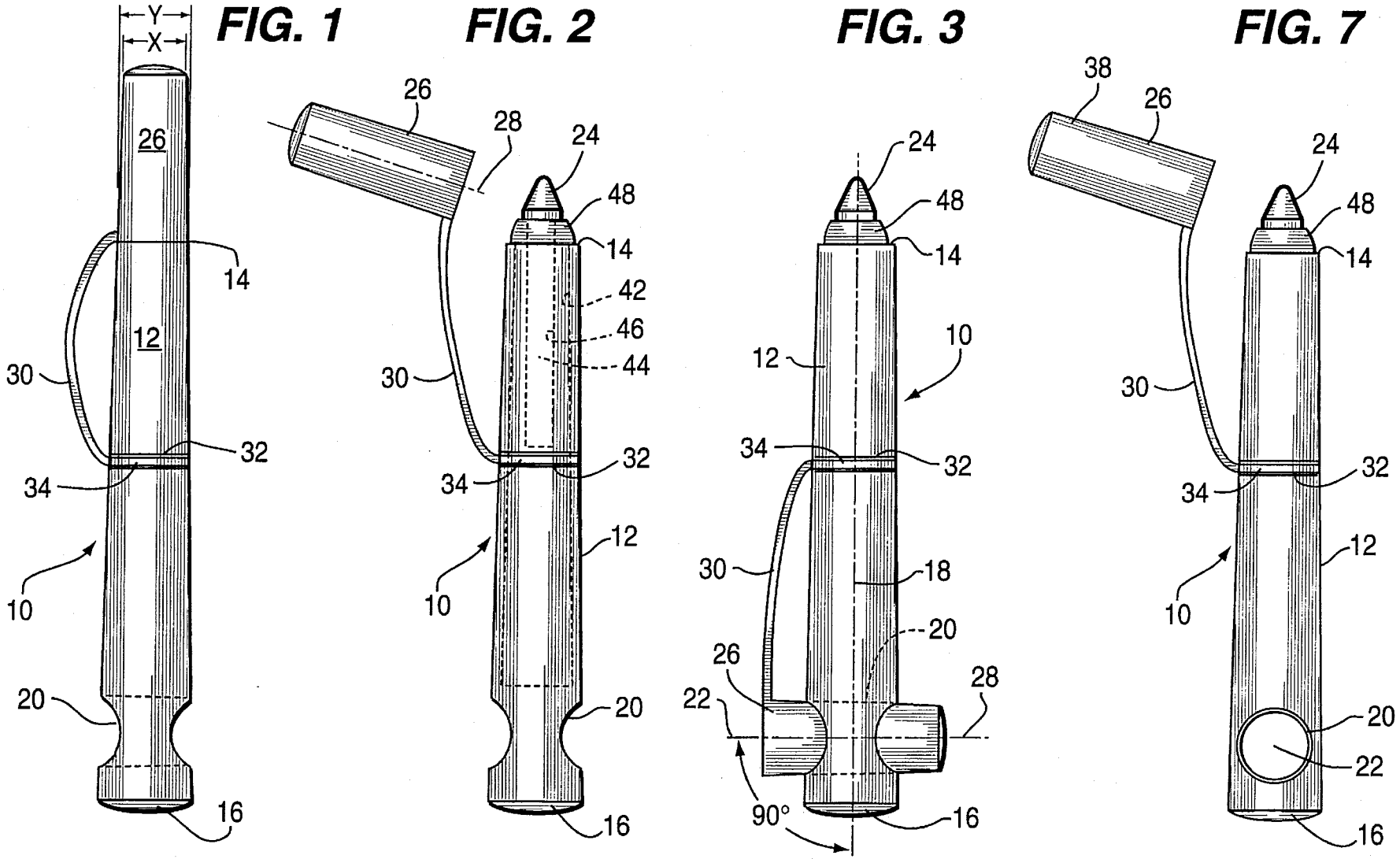
FIG. 1 is a side plan view of an embodiment of an improved marking pen in accordance with the present invention showing the cap in place extending over the marking tip thereof.
FIG. 2 is a side plan view of the embodiment shown in FIG. 1 with the cap shown removed from engagement with the first end of the pen barrel.
FIG. 3 is a further view of the embodiment shown in FIG. 1 with the pen cap shown in position extending through the cap retaining bore with the axis thereof approximately perpendicularly oriented with respect to the axis of the pen barrel.
FIG. 7 is a illustration of the embodiment shown in FIG. 2 as viewed from the left.
Figure 4:
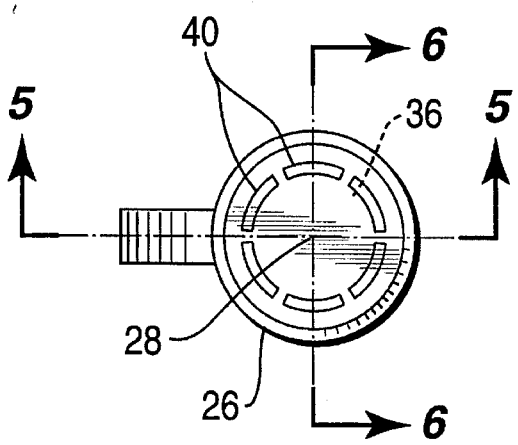
FIG. 4 is a top plan view of an embodiment of the cap of the present invention showing the venting means extending therethrough.
Figure 5:
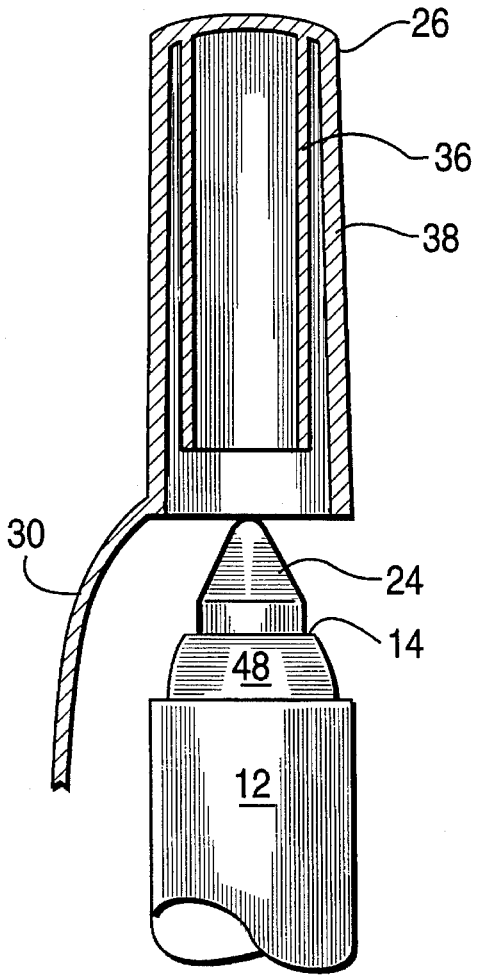
FIG. 5 is a side cross-sectional view of an embodiment of the cap means of the present invention shown prior or immediately after placement in position extending over the marking tip.
Figure 6:
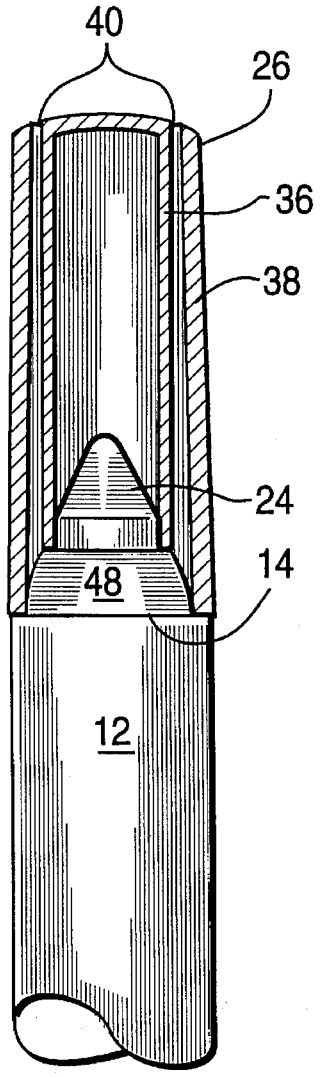
FIG. 6 is a view of the embodiment shown in FIG. 4 with the cap means having an inner and outer cap member shown in position covering the marking tip.

The present invention provides a uniquely designed marking pen apparatus 10 which includes a pen barrel 12 extending longitudinally and defining a barrel axis 18 as shown best in FIG. 3 extending therethrough. This pen barrel 20 will include a first end 14 and a second end 16 oppositely positioned from the first end 14.

The first end 14 will include a marking tip 24 therein and preferably will also include a reduced diameter flange 48 position thereon. First end 14 will include reduced diameter flange 48 in position extending about the marking tip 24 which protrudes outwardly from the first end Pen barrel 12 preferably defines a cap retaining bore 20 extending therethrough with the axis 22 of the generally tubular cap retaining bore being oriented approximately perpendicularly with respect to the barrel axis 18.

A cap 26 which is preferably of a tapered configuration is attached with respect to the pen barrel 12 by an attachment means 30. Cap 26 preferably defines a cap axis 28 extending longitudinally therethrough. The cap 26 is initially positionable extending over the marking tip 24 as shown best in FIG. 1.

While still attached by the attachment means 30 to the pen barrel 12, cap 26 can be removed as shown in FIG. 7. Cap 26 can be further moved downwardly as shown in FIG. 3 to a position where it is located extending into the Cap retaining bore 20 which is of a generally tubular configuration defined within the pen barrel 12. With the cap 26 extending through the cap retaining bore 20 the cap bore axis 22 and the cap axis 28 will be coincident with respect to one another.

With the cap in the position shown in FIG. 3 a wedging engagement will occur between the cap 26 and the cap retaining bore 20. This wedging engagement is possible because the preferred general configuration of the cap bore 20 is tubular whereas the preferred configuration of the cap means 26 is cylindrical or tubular but also tapered. With the cap means 26 tapered from the narrowed cap diameter X shown in FIG. 1 to the wider cap diameter Y also shown in FIG. 1, the wedging engagement will be apparent which is possible when the cap 26 is placed into the cap retaining bore 20. By the exerting of a force laterally to the right as shown in FIG. 3 the cap 26 will become wedged in position fixed but removable within the cap retaining bore 20.

The means of attachment of the cap 26 with respect to the pen barrel 12 by the attachment means 30 is preferably formed by a flexible strap which comprises the attachment means 30. This flexible strap may be of a resilient plastic or rubber type material and may be fixedly secured to the cap as shown in the figures of the present application. The opposite end of the attachment means 30 may include a closed loop 34 formed of this flexibly resilient material which is positionable within an attachment slot 32 defined on the outer surface of the pen barrel 12. The attachment slot 32 preferably is defined as a slot being rectangular or square in cross section but extending peripherally around the outer circumference at a single location along the outer surface of the pen barrel 12. Tis configuration is shown in FIGS. 1–3 and 7. Preferably this closed loop 30 is formed also of the same flexibly resilient material that the attachment strap 30 is formed from. As such, the closed loop 34 will be flexible to be stretched a slightly opened position such that it can be slid along the outer surface of the pen barrel 12 to be released when located in the attachment slot 32 such that he flexibly resilient closed loop 34 will snap in place therewithin. With this configuration the closed loop will be free to rotate while maintained within the attachment slot 32 to facilitate movable positioning of the cap as desired by a person during writing if the person for one reason or another decides not to place the cap in position extending through the cap retaining bore 20. In any case flexibility and universal positioning is made possible by movable engagement between the closed loop 34 and the attachment slot 32.

The configuration of the cap of the present invention may include an inner cap 36 as well as an outer cap 38. These two caps are fixedly secured with respect to one another within the overall configuration of the cap 26. The inner cap 36 is defined to be engageable with respect to the reduced diameter flange 48 positioned about the marking tip 24. With inner cap 36 in engagement with the flange 48 ambient air will be prevented from contacting the marking tip 24 thereby minimizing unwanted drying thereof and maintaining proper and efficient marking characteristics for future use. The configuration of the cap 26 also includes an outer cap 38 extending around the inner cap 36 and defining vent apertures 40 extending through the cap 26 therebetween. These vent apertures 40 are safety apertures to prevent the cap 26 of the marking pen 10 of the present invention from being an air impervious unit.

The pen barrel 12 of the present invention preferably defines a barrel chamber 42 therein. This barrel chamber 42 is used for multiple purposes but most particularly is usable for retaining of a marking medium reservoir 46 therein. Marking medium reservoir 46 is designed to hold a fluid marking medium 44 therein in fluid flow communication with respect to the marking tip 24 to continuously supply fluid marking medium 44 thereto during the working life of the marking pen 10 of the present invention. The configuration of the marking medium reservoir 46 can be any type of a cartridge or holder for holding marking medium. With a conventional felt tip marking pen this may be a plastic or other housing including possibly a wick therein to facilitate the flow of the marking medium 44 to the marking tip 24. On the other hand, if the apparatus of the present invention is provided as a roller point ballpoint pen type configuration then the marking medium reservoir 46 will comprise a conventional ballpoint pen refill member, With any configuration for supplying marking medium to the marking tip 24 the novel characteristics of the present invention will be found to be extremely useful. These novel characteristics include the unique double tapping vented configuration of the cap of the present invention as well as the unique attachment means and the novel means for holding of the cap at an angle perpendicular with respect to the barrel of the pen. There are indeed numerous advantages for orienting the cap for storage perpendicular to the barrel of the pen rather than parallel to the barrel of the pen. One of the advantages is that the overall length of the marking pen will be less thereby reducing the moment arm of the pen and making it "feel" much lighter to the user when writing with the pen, Furthermore the length of the attachment device 30 can be significantly lessened thereby eliminating excess slack during certain modes of operation of the pen. Furthermore there is no need for any specific mating or mounting configuration on the second end 16 of the barrel 12 and any chosen design can be utilized for the head of the pen as desired in accordance with the design characteristics of the pen manufacturer.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An improved marking pen, with cap attachment and storage means and a detachable tip sealing device, which comprises:

A. a pen barrel means extending longitudinally and including a first end means and a second end means spatially disposed with respect to one another, said pen barrel means defining a barrel axis extending longitudinally therethrough, said pen barrel means defining a cap retaining bore means therein oriented approximately perpendicularly with respect to said barrel axis;

B. a marking tip means positioned adjacent said first end means of said pen barrel means to facilitate marking use of said improved marring pen;

C. a cap means extending longitudinally and defining a cap axis extending longitudinally therethrough, said cap means being attachable with respect to said first end means of said pen barrel means in position with said cap axis and said barrel axis being coincident with respect to one another and with said cap means extending over said marking tip means to prevent marking therewith, said cap means being detachable with respect to said first end means to facilitate marking with said marking tip means, said cap means being detachably securable extending within said cap retaining bore means with said cap axis oriented approximately perpendicularly with respect to said barrel axis; and D. an attachment means secured to said cap means and attached with respect to said pen barrel means to facilitate retainment of said cap means.

2. An improved marking pen, with cap attachment and storage means and a tip sealing device, as defined in claim 1 wherein said attachment means is movably secured to said pen barrel means.

3. An improved marking pen, with cap attachment and storage means and a tip sealing device, as defined in claim 1 wherein said attachment means is detachably secured to said pen barrel means.

4. An improved marking pen, with cap attachment and storage means and a tip sealing device, as defined in claim 1 wherein said pen barrel means defines an attachment slot means extending therearound with said attachment means attached within said attachment slot means for attachment thereof with respect to said cap means.

5. An improved marking pen, with cap attachment and storage means and a tip sealing device, as defined in claim 4 wherein said attachment slot means is of circular shape and said attachment means includes a closed loop means positionable within said attachment slot means to facilitate movable securement thereof with respect to said pen barrel means.

6. An improved marking pen, with cap attachment and storage means and a tip sealing device, as defined in claim 5 wherein said closed loop means is formed of flexibly resilient material to facilitate detachable elastic retaining thereof peripherally within said attachment slot means.

7. An improved marking pen, with cap attachment and storage means and a tip sealing device, as defined in claim 1 wherein said cap means includes an inner cap means attachable with respect to said first end means of said pen barrel means for extending thereover and sealing of said marking tip means from the ambient environment.

8. An improved marking pen, with cap attachment and storage means and a tip sealing device, as defined in claim 7 wherein said cap means includes an outer cap means extending around said inner cap means and being attachable with respect to said first end means of said pen barrel for extending over said marking tip means to prevent marking therewith.

9. An improved marking pen, with cap attachment and storage means and a tip sealing device, as defined in claim 8 wherein said cap means defines vent aperture means therewithin located between said inner cap means and said outer cap means to facilitate passing of air therethrough.

10. An improved marking pen, with cap attachment and storage means and a tip sealing device, as defined in claim 7 wherein said outer cap means and said inner cap means are concentric with respect to one another.

11. An improved marking pen, with cap attachment and storage means and a tip sealing device, as defined in claim 1 wherein said pen barrel means defines an barrel chamber means therein.

12. An improved marking pen, with cap attachment and storage means and a tip sealing device, as defined in claim 11 further comprising a marking medium reservoir positioned within said barrel chamber means and connected to said marking tip means to facilitate marking therewith.

13. An improved marking pen, with cap attachment and storage means and a tip sealing device, as defined in claim 12 further comprising a fluid marking medium positioned within said marking medium reservoir which is in fluid flow communication with respect to said marking tip means to facilitate marking therewith.

14. An improved marking pen, with cap attachment and storage means and a tip sealing device, as defined in claim 1 wherein said attachment means is formed of flexibly resilient material to facilitate attachment of said cap means with respect to said pen barrel means.

15. An improved marking pen, with cap attachment and storage means and a tip sealing device, as defined in claim 1 wherein said cap retaining bore means is tubularly shaped to facilitate retaining of said cap means therein.

16. An improved marking pen, with cap attachment and storage means and a tip sealing device, as defined in claim 1 wherein said cap means is longitudinally tapered to facilitate wedging engagement thereof extending through said cap retaining bore means.

17. An improved marking pen, with cap attachment and storage means and a tip sealing device, as defined in claim 1 wherein said first end means includes a reduced diameter flange means thereon Positioned in surrounding relationship to said marking tip means to facilitate marking therewith and covering thereof with said cap means.

18. An improved marking pen, with cap attachment and storage means and a tip sealing device, as defined in claim 1 wherein said attachment means is of sufficient length to allow positioning of said cap means in position detachably retained extending through said cap retaining bore means.

19. An improved marking pen, with cap attachment and storage means and a tip sealing device, as defined in claim 1 wherein said attachment means is of sufficient length to allow positioning of said cap means in position detachably secured with respect to said first end means of said pen barrel means extending over said marking tip means.

20. An improved marking pen, with cap attachment and storage means and a detachable tip sealing device, which comprises:

A. a pen barrel means extending longitudinally and including a first end means and a second end means spatially disposed with respect to one another, said pen barrel means defining a barrel axis extending longitudinally therethrough, said pen barrel means defining a cap retaining bore means therein oriented approximately perpendicularly with respect to said barrel axis and being tubularly shaped, said pen barrel means defining a peripheral attachment slot means extending therearound;

B. a marking tip means positioned adjacent said first end means of said pen barrel means to facilitate marking use of said improved marking pen;

C. a cap means extending longitudinally and defining a cap axis extending longitudinal therethrough, said cap means being tapered longitudinally therealong to facilitate selective wedging engagement thereof with respect to said cap retaining bore means, said cap means being attachable with respect to said first end means of said pen barrel means in position with said cap axis and said barrel axis being coincident with respect to one another and with said cap means extending over said marking tip means to prevent marking therewith, said cap means being detachable with respect to said first end means to facilitate marking with said marking tip means, said cap means being detachably securable extending within said cap retaining bore means with said cap axis oriented approximately perpendicularly with respect to said barrel axis, said cap means including an inner cap means attachable with respect to said first end means of said pen barrel means for extending thereover and sealing of said marking tip means from the ambient environment, said cap means further including an outer cap means extending around said inner cap means and being attachable with respect to said first end means of said pen barrel means for extending over said marking tip means to prevent marking therewith, said cap means defining a vent aperture means therewithin located between said inner cap means and said outer cap means to facilitate passing of air therethrough, said inner cap means and said outer cap means being concentric with respect to one another; and D. an attachment means formed of flexibly resilient material and including a closed loop means, said attachment means being secured with respect to said cap means and said closed loop means being movably secured within said peripheral attachment slot means of said pen barrel means to facilitate retainment of said cap means with respect to said barrel means, said attachment means being of sufficient length to allow selectlvely positioning of said cap means in position detachably retained extending through said cap retaining bore means and in position detachably secured with respect to said first end means of said pen barrel means extending over said marking tip means.

* * * * *

UNITED STATES PATENT AND TRADEMARK OFFICE

CERTIFICATE OF CORRECTION

PATENT NO. : 5,590,971

DATED : January 7, 1997

INVENTOR(S) : Norman Melnick

It is certified that error appears in the above-identified patent and that said Letters Patent is hereby corrected as shown below:

Title page, item [57],
In the Abstract, line 8, change "shade" to -- shape --.

In the Abstract, line 10, after "way", change "or"

to -- of --.

Signed and Sealed this

Eighth Day of April, 1997

Bruce Lehman

*Attest:*

BRUCE LEHMAN

*Attesting Officer*

*Commissioner of Patents and Trademarks*